US005682178A

United States Patent [19]

Gibert et al.

[11] Patent Number: 5,682,178

[45] Date of Patent: Oct. 28, 1997

[54] METHOD FOR DISPLAYING PARTS OF A STOREOD IMAGE

[75] Inventors: Bertrand Gibert, Issy les Moulineaux; Fréderic Oberkampf, Neuilly sur Seine, both of France

[73] Assignee: U.S. Philips Corporation, New York, N.Y.

[21] Appl. No.: 656,999

[22] Filed: May 28, 1996

Related U.S. Application Data

[63] Continuation of Ser. No. 470,580, Dec. 21, 1993, abandoned, which is a continuation of Ser. No. 882,334, May 13, 1992, abandoned.

[30] Foreign Application Priority Data

May 31, 1991 [FR] France ..... 91 06587

[51] Int. Cl.[6] ..... G09G 5/38; G09G 5/34

[52] U.S. Cl. ..... 345/123; 345/121

[58] Field of Search ..... 340/723, 724, 340/726, 798, 799, 995; 395/162, 164, 165, 511; 345/121, 123, 125, 345, 395

[56] References Cited

U.S. PATENT DOCUMENTS

| | | | |
|---|---|---|---|
| 4,129,859 | 12/1978 | Iwamura et al. | 340/724 X |
| 4,442,495 | 4/1984 | Sukonick | 340/726 |
| 4,602,251 | 7/1986 | Sawada et al. | 340/724 |
| 4,845,631 | 7/1989 | Bottorf | 340/995 X |
| 4,943,937 | 7/1990 | Kasano et al. | 395/164 |
| 5,006,837 | 4/1991 | Bowers | 340/724 |
| 5,053,761 | 10/1991 | Webster | 340/704 X |

FOREIGN PATENT DOCUMENTS

| | | | |
|---|---|---|---|
| 0293794 | 12/1990 | Japan | 340/724 |
| 0219291 | 9/1991 | Japan | 340/724 |

*Primary Examiner*—Jeffery Brier

*Attorney, Agent, or Firm*—Laurie E. Gathman; Arthur G. Schaier

[57] ABSTRACT

The method divides the buffer memory of an interactive processing and display means in a manner which permits the user to select a portion of a stored image defined by a variable set of address boundaries defining a portion of memory residing within a larger portion of memory defined by another set of address boundaries which in turn resides within a global portion of memory defined by yet another set of address boundaries. The user can vary the variable set of address boundaries so that if they intersect with the address boundaries of the larger portions of memory in which they reside, the buffer memory is updated from a bulk memory.

2 Claims, 13 Drawing Sheets

FIG. 3

| | | | | | | | | | | | | |
|---|---|---|---|---|---|---|---|---|---|---|---|---|
| CH1 | B1 | B4 | B7 | B10 | B13 | B16 | B19 | B22 | B25 | B28 | B31 | B34 |
| CH2 | B2 | B5 | B8 | B11 | B14 | B17 | B20 | B23 | B26 | B29 | B32 | B35 |
| CH3 | B3 | B6 | B9 | B12 | B15 | B18 | B21 | B24 | B27 | B30 | B33 | B36 |
| CH1 | B37 | B40 | -- | -- | -- | -- | -- | -- | -- | -- | -- | B70 |
| CH2 | B38 | -- | -- | -- | -- | -- | | | -- | -- | -- | B71 |
| CH3 | B39 | -- | -- | | | | | | | | -- | B72 |
| CH1 | B73 | | | | | | | | | | | B106 |
| CH2 | B74 | | | | | | | | | | | B107 |
| CH3 | B75 | -- | -- | -- | -- | -- | -- | -- | -- | -- | -- | B108 |

METHOD FOR DISPLAYING PARTS OF A STOREOD IMAGE

This is a continuation of application Ser. No. 08/470,580, filed Dec. 21, 1993 which is a continuation of Ser. No.07/882,334 filed May 13, 1992 both now abandoned.

BACKGROUND OF THE INVENTION

The present invention relates to a device for displaying a part of an image, said device comprising:

a bulk memory for storing said image;

a buffer memory for receiving from the bulk memory data representing at least a part to be displayed;

a display unit having a screen for displaying said part;

a user interface for selecting a first part to be displayed and subsequent parts obtained by scrolling produced by actuating a movement control.

These devices have important applications for displaying geographical maps on, for example, a normal cathode ray tube screen. Since such maps generally include many details, the display unit only enables part of them to be reproduced at a time. By means of the user circuit, parts of the image are selected successively so that an impression is obtained of moving the map. For the comfort of the user, this movement must be produced gently and without jerks.

U.S. Pat. No. 4,602,251 describes such a device. This known device comprises a buffer memory whose capacity is designed to contain, on the one hand, data representing the partial view to be displayed and, on the other hand, regeneration data coming from the bulk memory and intended to update the view displayed on the screen when a movement of the image is desired by the user.

This known device has the disadvantage that the buffer memory is larger than necessary and involves the use of a rapid access bulk memory.

SUMMARY OF THE INVENTION

The present invention relates to a device of the kind referred to in the preamble, which enables a buffer memory of lower capacity to be used and which does not require a rapid access bulk memory.

For that, such a device is characterized in that the buffer memory comprises:

a global section comprising a hierarchy of subsections:
- a transfer subsection, containing
- a reading subsection, containing
- a screen subsection, corresponding to the part to be displayed, said screen subsection being moved in accordance with the movement control;

a supplementary section for receiving, in anticipation on the moving of the screen subsection, data from the bulk memory when an edge of the screen subsection touches an edge of the reading subsection, the data in the supplementary section being transferred to the global section when said edge of the screen subsection touches an edge of the transfer subsection, said transfer and reading subsections then being updated in response to the moving of the screen subsection.

The present invention is especially suitable for application in the Compact Disc-Interactive system as described in the book "Compact Disc-Interactive, A Designer's Overview" by J. M. Preston, Philips International, published by Kluwer Technical Boob Deventer, Antwerp, Belgium.

In fact, compact discs contain a lot of data and access to a given item of data is relatively slow. The invention to a large extent overcomes this slow access.

BRIEF DESCRIPTION OF THE DRAWINGS

The following description, accompanied by the appended drawings, all given as a non-limiting example, will enable a clearer understanding to be gained of how the invention may be produced.

FIG. 3 shows how the block of pixels of the image are organized;

DETAILED DESCRIPTION OF THE PREFERRED EMBODIMENTS OF THE INVENTION

Figure 1:
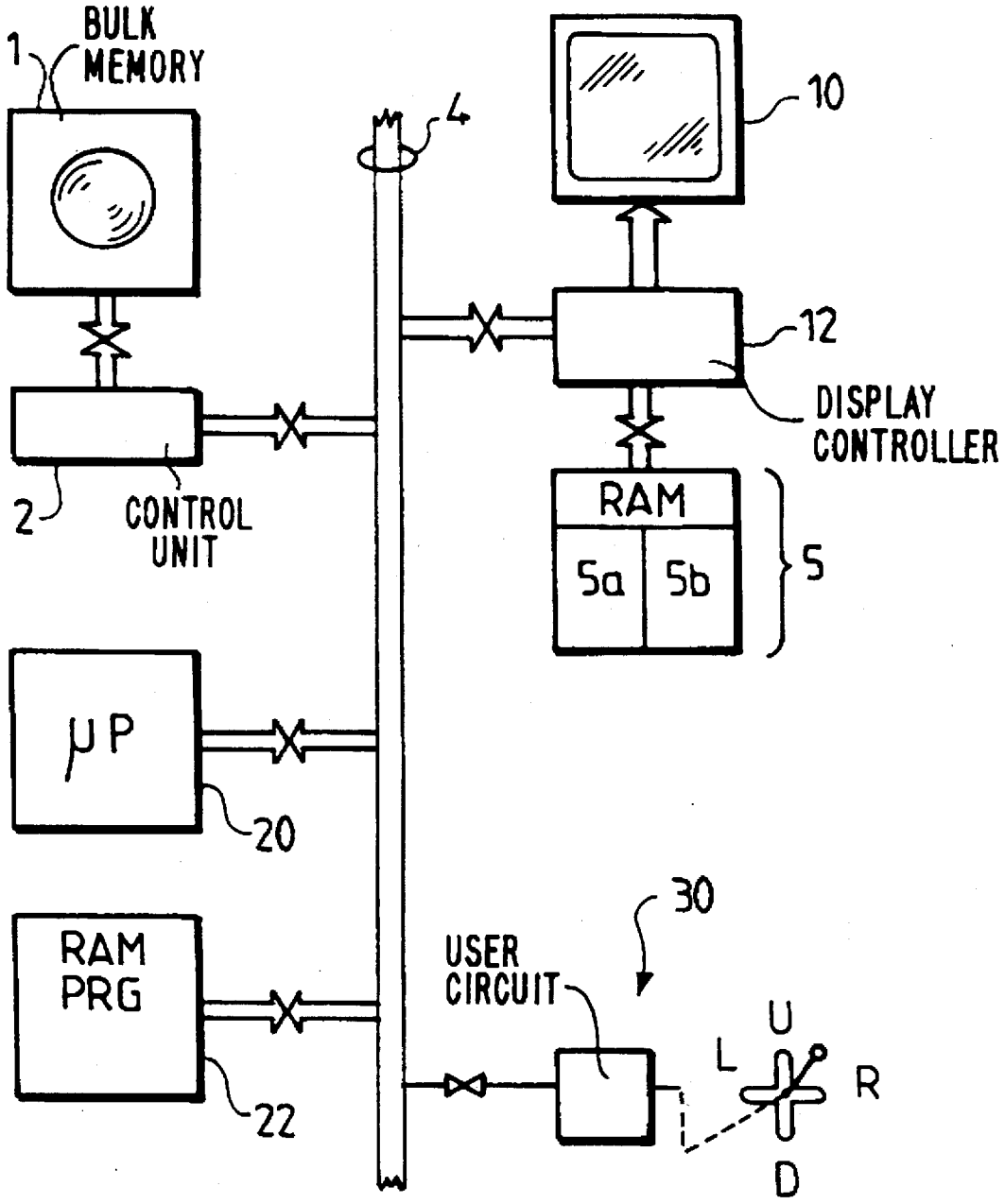
FIG. 1 PRIOR ART
FIG. 1 represents a diagram of the device of the invention.

The device of FIG. 1 comprises first of all a bulk memory 1 containing all the data relating to the pixels of a geographical map. This memory consists of an optical disc installed in its reader which is controlled by a control unit 2. The data taken from this memory can be sent via a common line (a bus) 4 to a buffer memory 5 which is divided into at least two sections:

a first section 5*a*, termed the global section, a subsection of which is read so as to make the image appear on the display unit 10 via a display controller 12, a second section 5*b*, termed the supplementary section.

Also connected to the common line 4 also are a microprocessor 20 which controls all the operations, and a program memory 22 containing the program to be run, which can be loaded when the device is started up from the bulk memory 1.

A user circuit 30 is also provided in order to select a partial view, shown on the screen 10, of the whole image stored in the bulk memory 1. Four movements can be chosen:

U: movement towards the top

D: movement towards the bottom

L: movement to the left

R: movement to the right.

The structure of the device shown in FIG. 1 is that of a product known under the name of CDI (see the book mentioned above).

In order to explain the invention clearly, a very special case with numerical values will be described for reasons of clarity. It is, however, understood that the invention is not limited to this example.

Figure 2:
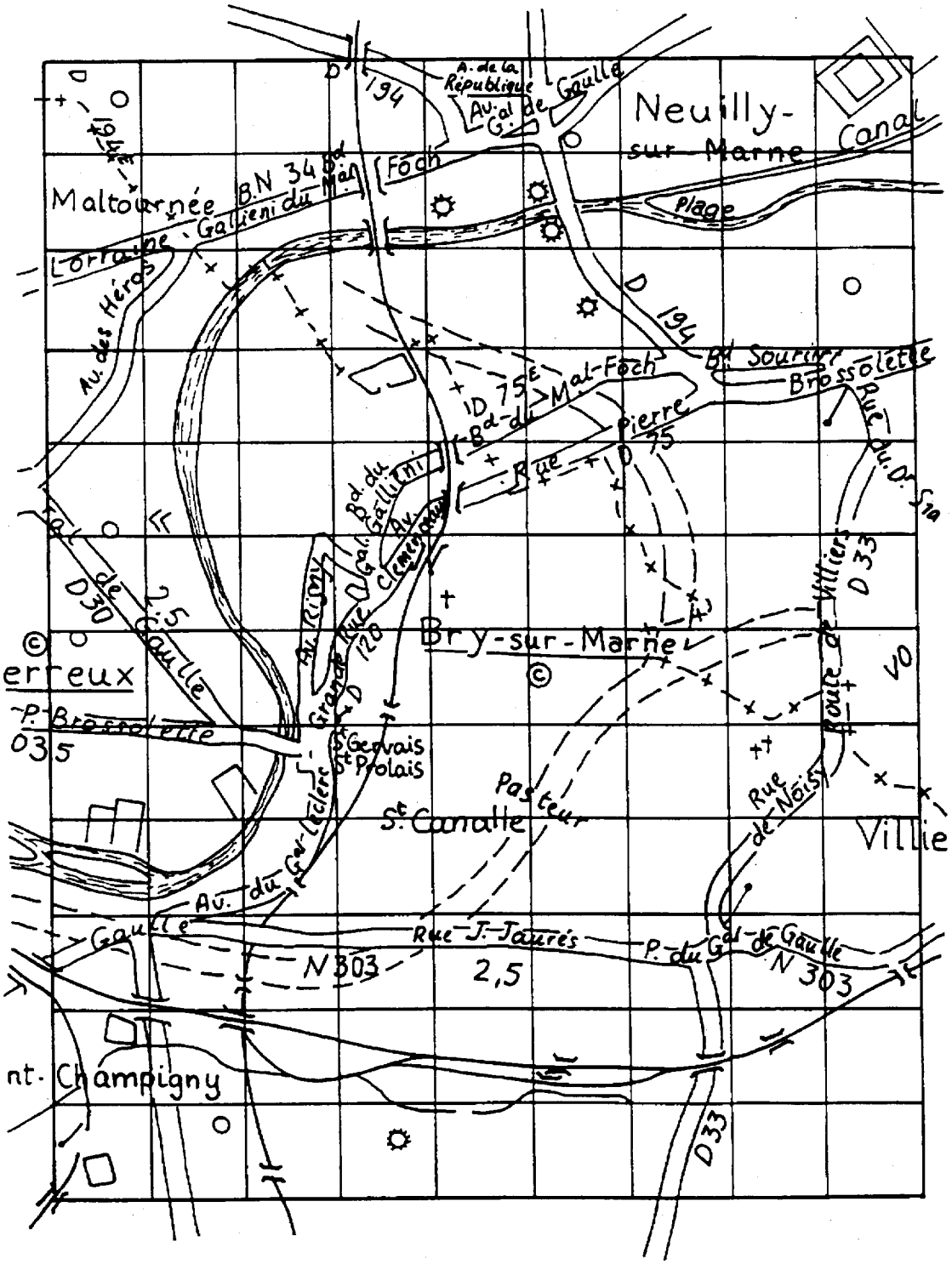
FIG. 2 shows an image (geographical map) to be displayed.

First of all, the way in which the image is stored will be described; in this example, this is a geographical map shown in FIG. 2. This map is divided into 108 blocks whose respective reference numbers and locations are explained in FIG. 3.

These blocks bear the reference numbers B1 to B108.

Figure 4:
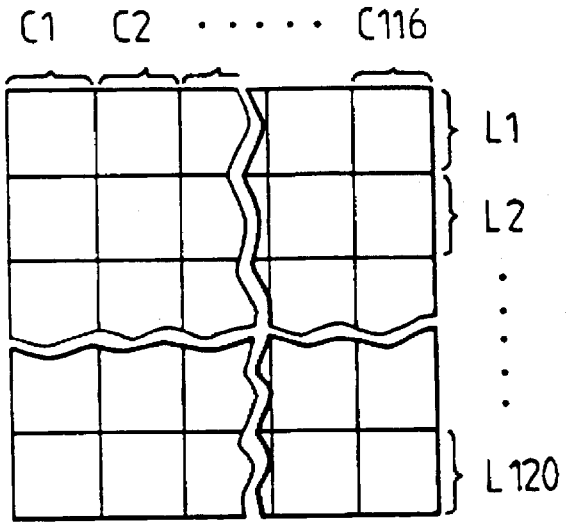
FIG. 4 shows how a block of pixels is divided up.

FIG. 4 shows the constitution of each of these blocks. The blocks consist of 116 columns of pixels C1 to C116 and each column consists of 120 pixels, so that each block also consists of 120 rows L1 to L120 of 116 pixels.

In order to record the images, advantage is taken of one of the facilities of CDI brought by these channels: thus, blocks B1, B4, . . . , B34, B37, . . . , B70, B73, . . . , B106 are recorded via channel CH1, blocks B2, B5, . . . , B35, B38, . . . , B71, B74, . . . , B107 via channel CH2, and blocks B3, B6, . . . , B36, B39, . . . , B72, B75, . . . , B108 via channel CH3.

So, in FIG. 3 the blocks B1 to B36 form a first group, blocks B37 to B72 form a second group and blocks B73 to B108 form a third group. The image is processed group by group. In each group the blocks are processed column by column, each row being associated with one channel: B1 via CH1, B2 via CH2, B3 via CH3, B4 via CH1, B5 via CH2, etc.

It will be recalled that up to 32 channels can be used, but hem only 3 are used.

Figure 5:
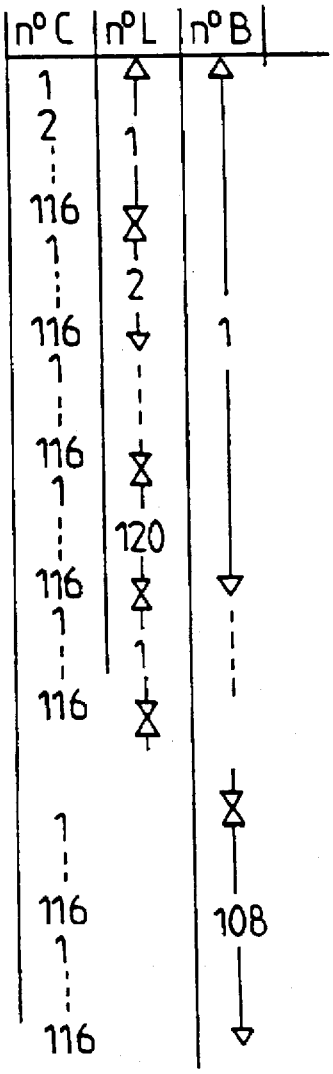
FIG. 5 shows the way in which the various pixels are recorded in the bulk memory.

FIG. 5 shows the sequence in which the data are recorded. Blocks B1, B2, B3, . . . , B108 are recorded in that order, in turn, beginning with the 116 pixels of row L1 up to row L120.

It is from these data that the buffer memory 5 will be loaded. This memory contains 20 adjacent blocks (5×4) taken among the 108.

It should be pointed out that the complete loading of this memory is carried out in two stages.

Figure 6:
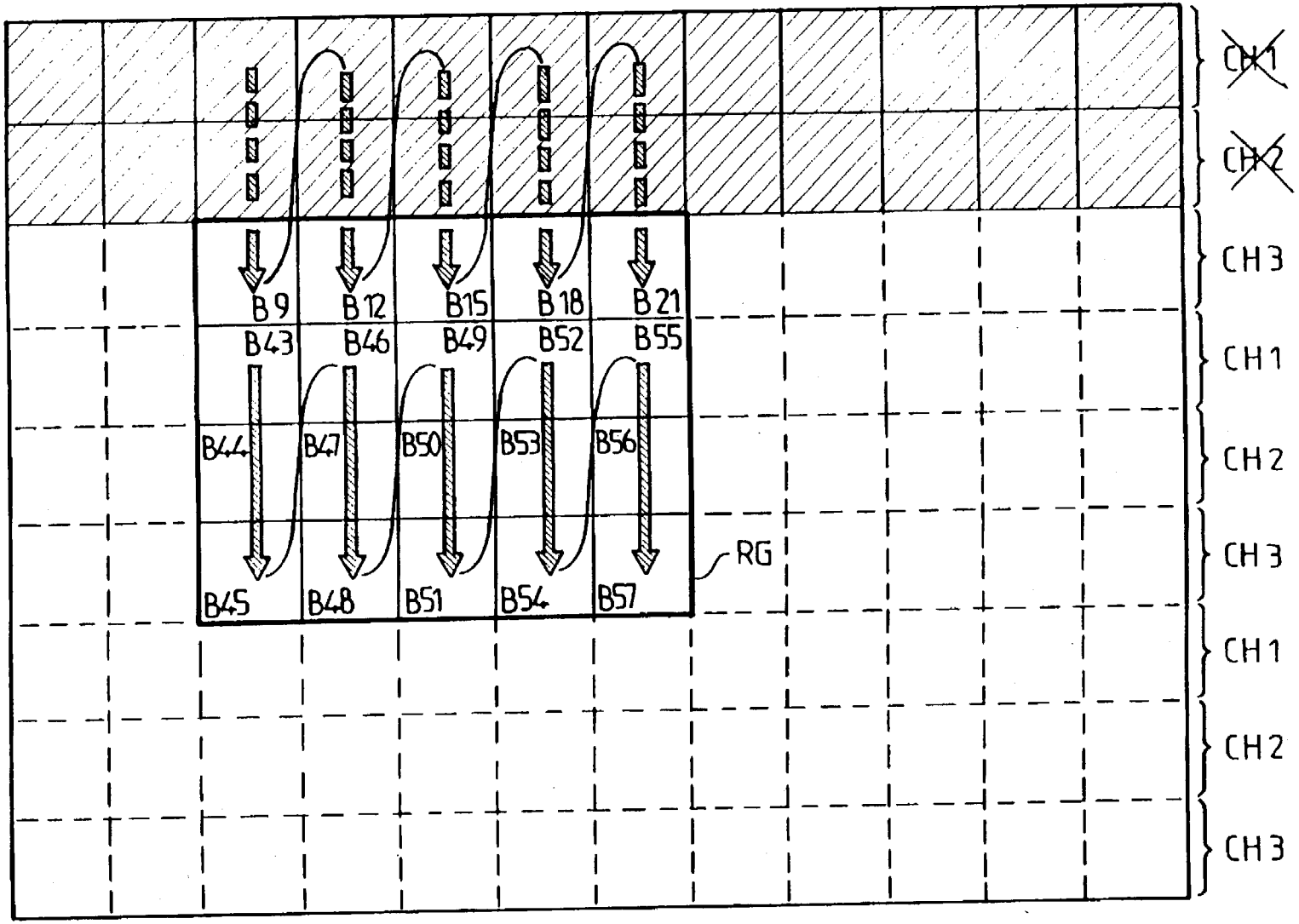
FIG. 6 shows how the buffer memory can be loaded from the bulk memory.

For example, if one wishes to load the memory 5 with blocks B9, B12, B15, B18, B21 and B43 to B57, this is achieved in a first stage by opening channel 3 in order to read into the bulk memory blocks B9, B12, B15, B18 and B21, and by closing channels 1 and 2, and in a second stage by opening channels CH1, CH2 and CH3 in order to read blocks B43 to B57; this is explained in FIG. 6.

Twenty blocks are thus recorded in the buffer memory 5 in section 5a. Out of all the pixels in these 20 blocks (20×116×120=278400), only 107520 (=384×280) are taken into the buffer memory to be displayed on the display unit 10.

These blocks are arranged in the buffer memory in such a way that, by addressing it continually, it is possible to cause the image to appear.

Thus, for example, the addresses "0 to 115" contain the pixels of row L1 of block B9, the addresses "116 to 231" the pixels of row L1 of block B12, then row L1 of blocks B15, B18, B21, then row L2 of these same blocks B9, B12, B15, B18, B21 and so on up to row L120. Then it will be the turn of row L1 of these blocks. These different addresses are represented in FIG. 7 with a prefix ADR.

Figure 7:
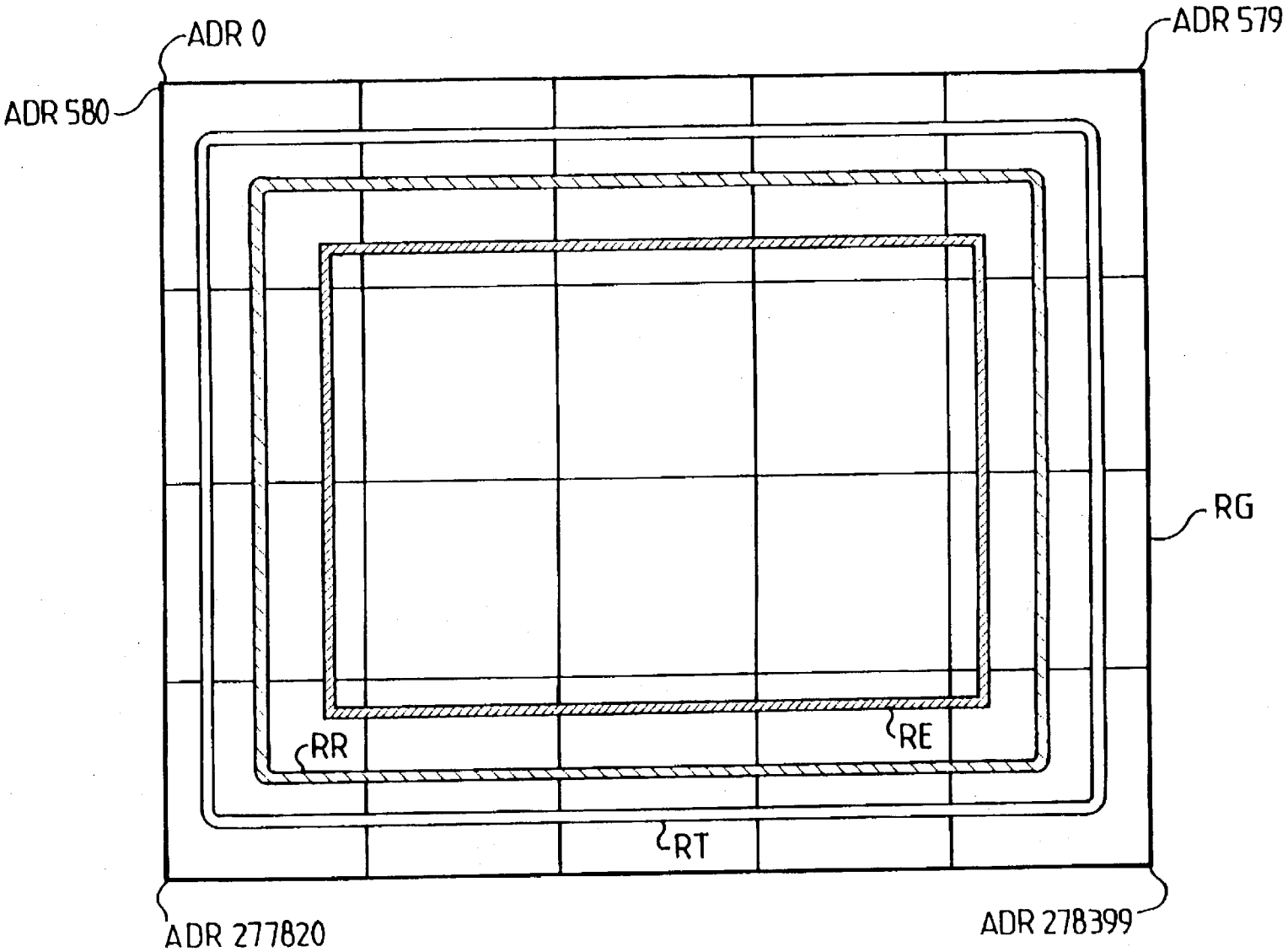
FIG. 7 shows the different rectangles: the global rectangle, the reading rectangle, the transfer rectangle.

According to the invention, the various sub-sections represented in FIG. 7 are defined in the buffer memory 5, and more precisely in section 5a, by the following rectangles:

- rectangle RG, which corresponds to all the addressing of section 5a, that is to say the address codes ADR0 to ADR278399,
- rectangle RT, which corresponds to the transfer sub-section beginning at the address ADR17400 and extending over 520 pixels ×420 rows,
- rectangle RR, which corresponds to the reading sub-section beginning at the address ADR30210 and extending over 480 pixels ×376 rows,
- rectangle RE corresponding to the screen sub-section, which moves inside the aforesaid rectangles as a function of the "U", "D", "R" and "L" movement requested and which extends over 384 pixels×280 rows.

Figure 8:
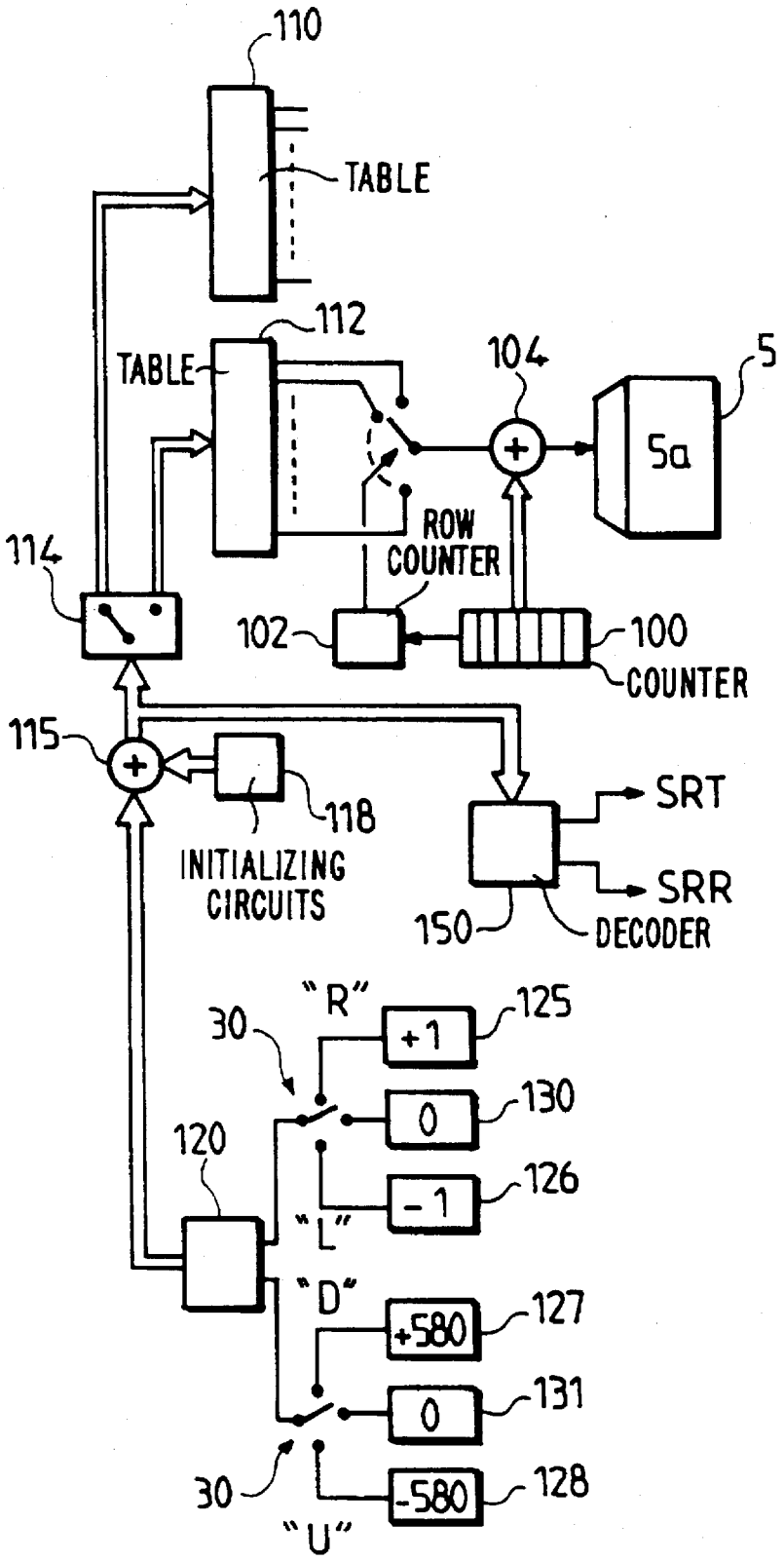
FIG. 8 is a diagram explaining the addressing of the buffer memory for the display.

FIG. 8 shows how the buffer memory is addressed and, more particularly, the addressing of the pixels located in the screen rectangle.

A counter 100 is first provided, having a capacity equal to the number of pixels contained in one row, namely 580, each passage of the counter to zero is enumerated in a row counter 102.

The contents of the counter will be modified by an adder 104 receiving data at other inputs giving the address of each row. These row data give for each row the address of the first pixel which must be read into the memory 5a. These data are contained in a double table 110 and 112. One of these tables is read (in FIG. 8 it is table 112), while the other is updated: this is table 100, preferably during the frame flyback time. Each start of a row contained in the memory 112 is selected by means of the row counter 102. A switch 114 enables the tables 110 and 112 to be loaded alternately.

These start-of-row addresses are worked out by means of a modulo 278400 adder 115, and hence correspond to the addressing field of the Global Rectangle RG adding, on the one hand, the start-of-row initial conditions, corresponding for example to the centering of the rectangle RE in the global rectangle, and, on the other hand, the accumulations accumulating the requests for horizontal or vertical movements carried out by means of controls 30. The initial conditions are obtained by initializing circuits indicated in FIG. 8 by a box 118 and the accumulations are obtained by an accumulator 120. The accumulator provides the shift to be given to each row as a function of the movement requested, +1 for a movement to the right, −1 for a movement to the left, +580 for a movement towards the bottom and −580 for a movement towards the top. This is represented by the boxes 125, 126, 127 and 128 respectively. At rest, when no movement is requested, it is boxes 130 and 131 which are involved, the contents of the accumulator 120 remaining unchanged.

A decoder 150 connected to the adder 115 supplies signals SRT and SRR indicating the contact of the rectangle RE with the rectangles RT and RR respectively.

In order to understand the invention more clearly, only a movement to the fight will be described. It will then be easy to determine the operation for a movement to the left, towards the top or towards the bottom.

The situation to be used is that of the an arrangement indicated, that is to say that in which the global rectangle comprises the blocks B9, B12, B15, B18, B21, . . . , B54, B57.

Figure 9:
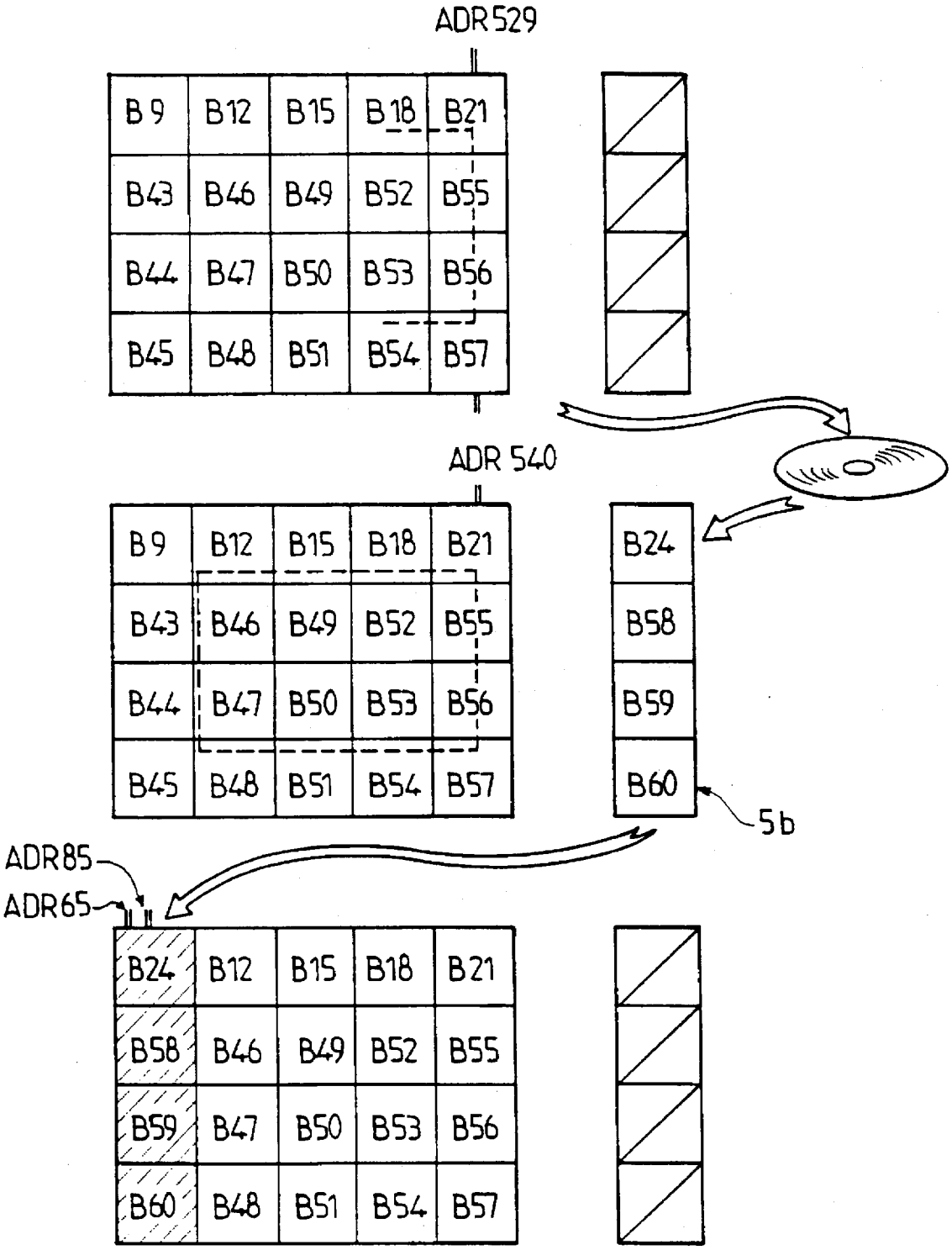
FIG. 9 and 10 show the transfer of blocks from the bulk memory to the buffer memory.

When the right-hand edge of RE touches the edge of the reading rectangle RR, which can easily be detected by processing the start-of-row cedes by comparison with the starting addresses of the reading rectangle codes (if the address code of the first row NL1 is such that N1L+384≧529– cf FIG. 9), there is a request for reading access to the CD reader, the data are then stored in section 5b of the memory; blocks B24, B58, B59 and B60 are recorded in section 5b of the memory.

If no additional movement is requested, no action is undertaken. On the other hand, if there is a persistent request for a movement to the fight, the screen rectangle will touch the transfer rectangle for example (N1L+384≧549), and the data contained in section 5b will then come to replace the old data, that is to say blocks B24, B58, B59 and B60 will replace blocks B9, B43, B44 and B45. The data transfer can be physical, but can also be on a logical level, as a reassignment of addresses.

It will be noted that the rather long access time for the data contained in the CD is overcome by this prior loading into section 5b.

It should be noted that the transfer is carried out in sections 5a of the memory which are unconnected with the section concerned with the screen rectangle and the display of the map on the screen is not affected.

This transfer is clearly accompanied by an updating of the definition of the reading rectangle RR, the screen rectangle RE and the transfer rectangle RT as regards the addressing of the memory 5a.

Figure 10:
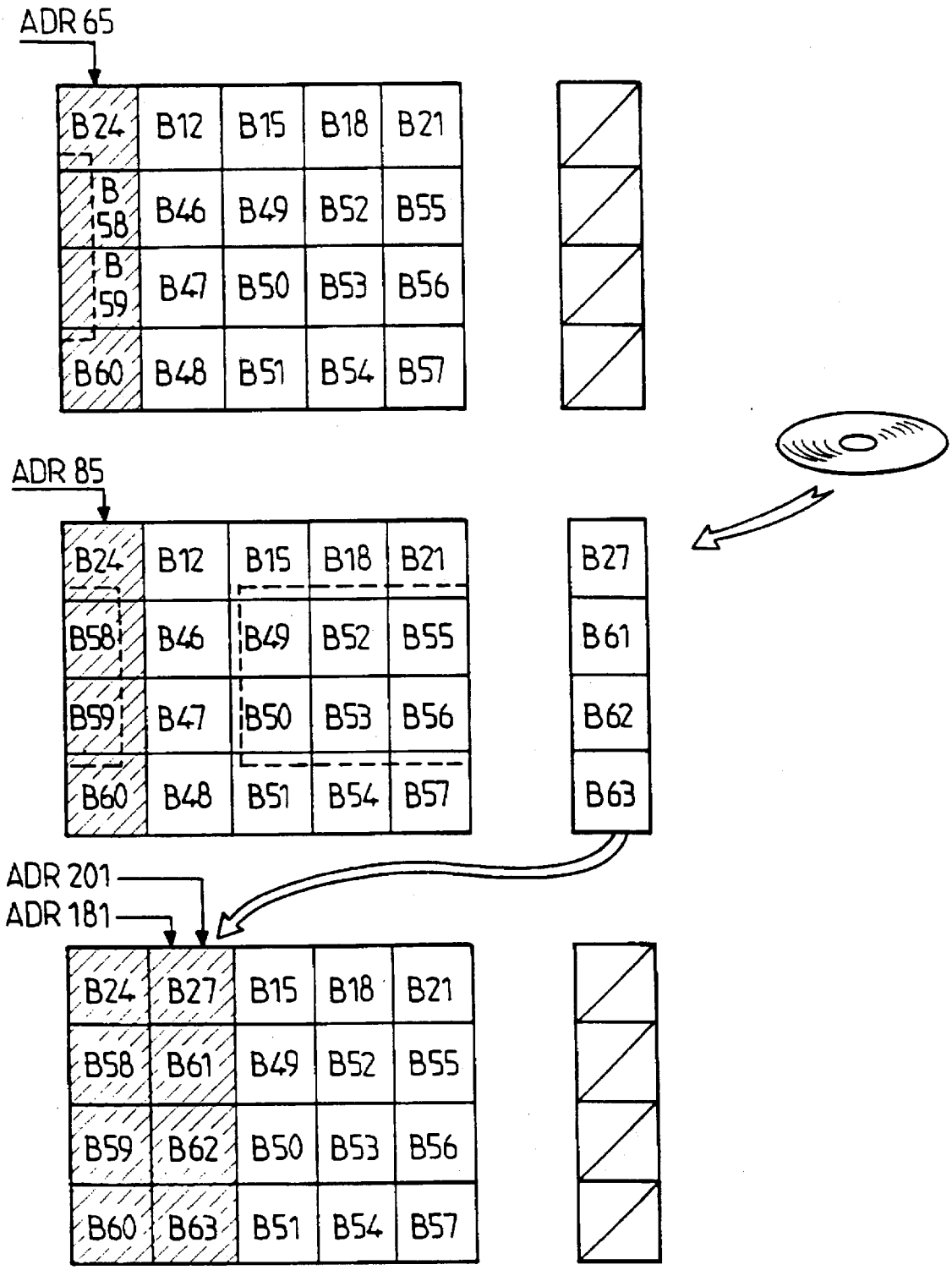

FIG. 10 represents the evolution of the data when there is a persistent request for a movement to the right. Thus, blocks B27, B61, B62 and B63 replace blocks B12, B46, B47 and B48.

It will be noted that the right-hand edges of the reading and transfer rectangles change from ADR65+k.580, ADR85+k.580 to ADR181+k.580, ADR201+k.580, where k represents the row number where this edge is considered to be.

Figure 11:
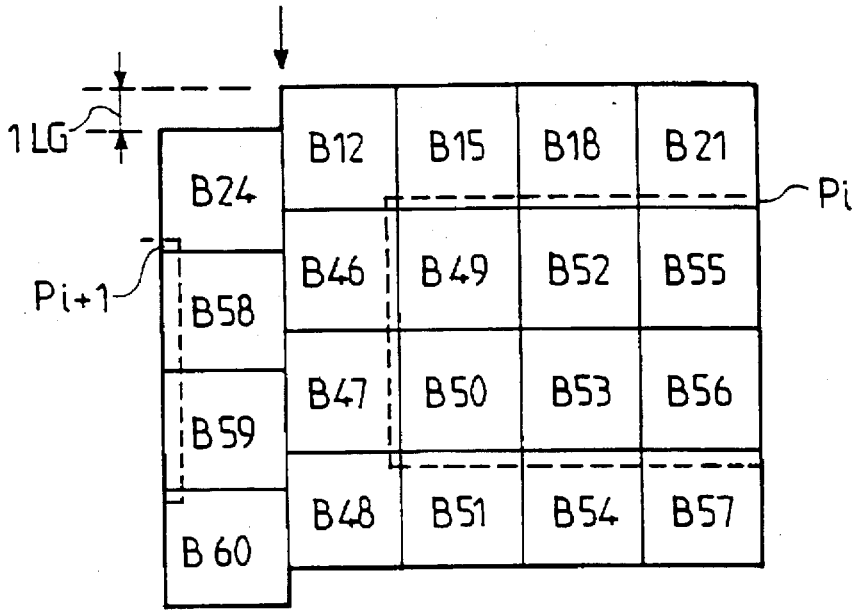
FIG. 11 shows the row change to be provided for during the transfer of a block value.

FIG. 11 provides a little more explanation of the transfer of blocks from section 5a to section 5b. In order to show that it is necessary to provide a row shift, blocks B24, B58, B59 and B60 have been shifted in this FIG. 11 towards the bottom in an exaggerated way in order to show this shift towards the bottom more clearly. This shift is justified by the fact that the pixel Pi situated on the border of the global rectangle RG must be situated alongside the pixel Pi+1 because of the one-dimensional filing used in data-processing memories. If the pixel Pi is located at the address ADR579+k.580, the pixel Pi+1 must be located at the address ADR580+k.580 or the address ADR0+(k+1)580, and therefore one row below.

Figure 12:
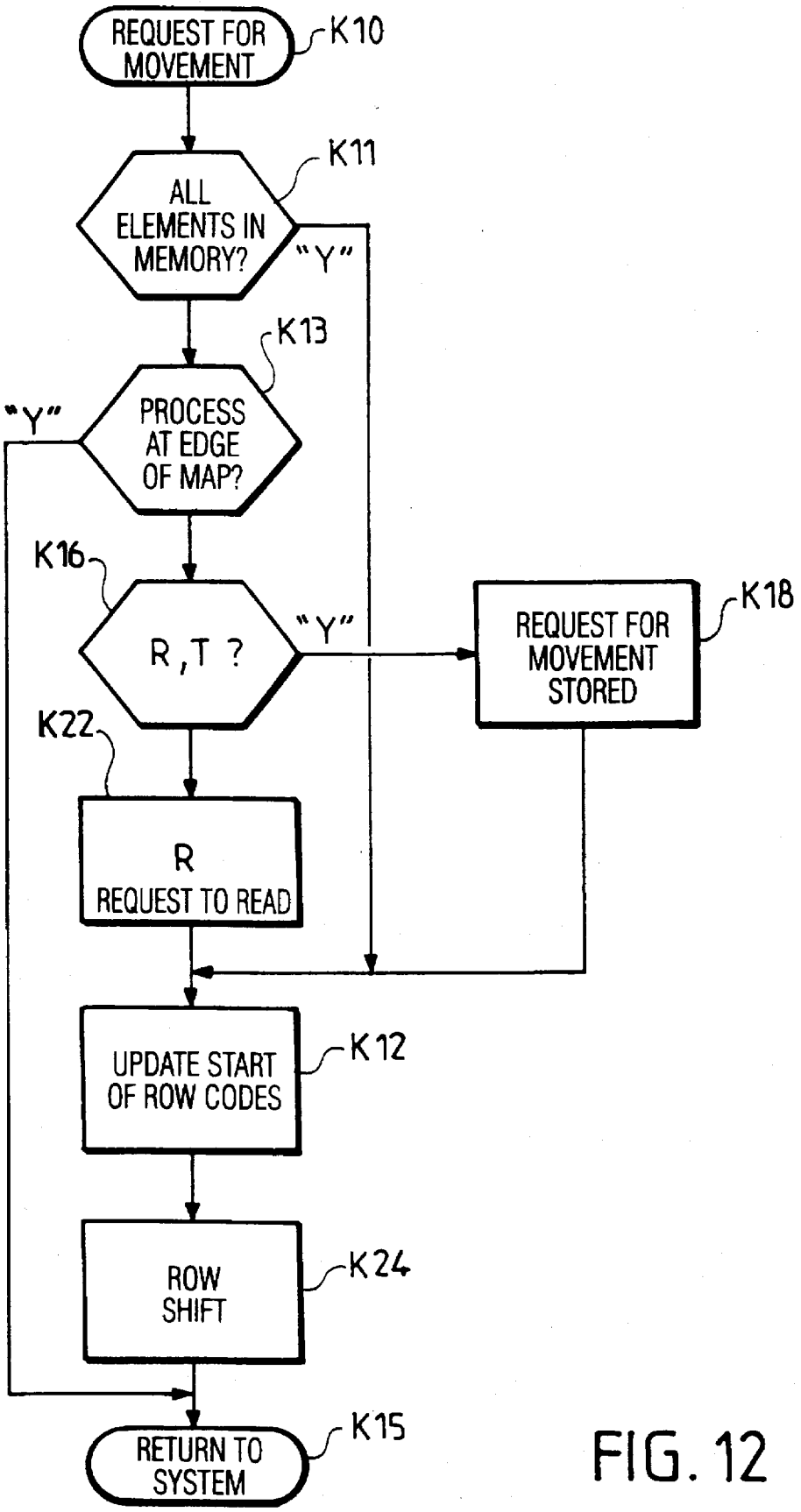
FIG.12, 13 and 14 show the flow charts explaining the operation of the device.

FIG. 12 shows a first flow chart explaining the operation of the device according to the invention.

The process explained by this flow chart is triggered when a request for a movement is made (box K10).

The process then starts by a test indicated at box K11, asking whether all the elements in the image to be displayed are contained in memory 5a. For that, the values of the start-of-row addresses increased by the increment imposed by the requested movement are compared with pre-established values. If the elements are so contained, then the process passes on to box K12.

If the elements are not so contained, a test is carried out to see whether the process is at the edge of the map (box K13). It is then impossible to load additional data from the compact disc. If this is impossible, no action is undertaken and there is a return to the system, box K15.

If a loading is possible, the process passes to box K16 where a test is carried out to see whether a request to read or transfer is in progress: if yes, the request for movement K18 is stored-in memory and the process passes to box K12. If there is no reading or transfer, the process passes to box K22 where a request to read is made.

The shift to be displayed is then prepared by updating the start of row cedes (box K12), the shift is then authorized (box K24) and there is a return to the system.

Figure 13:
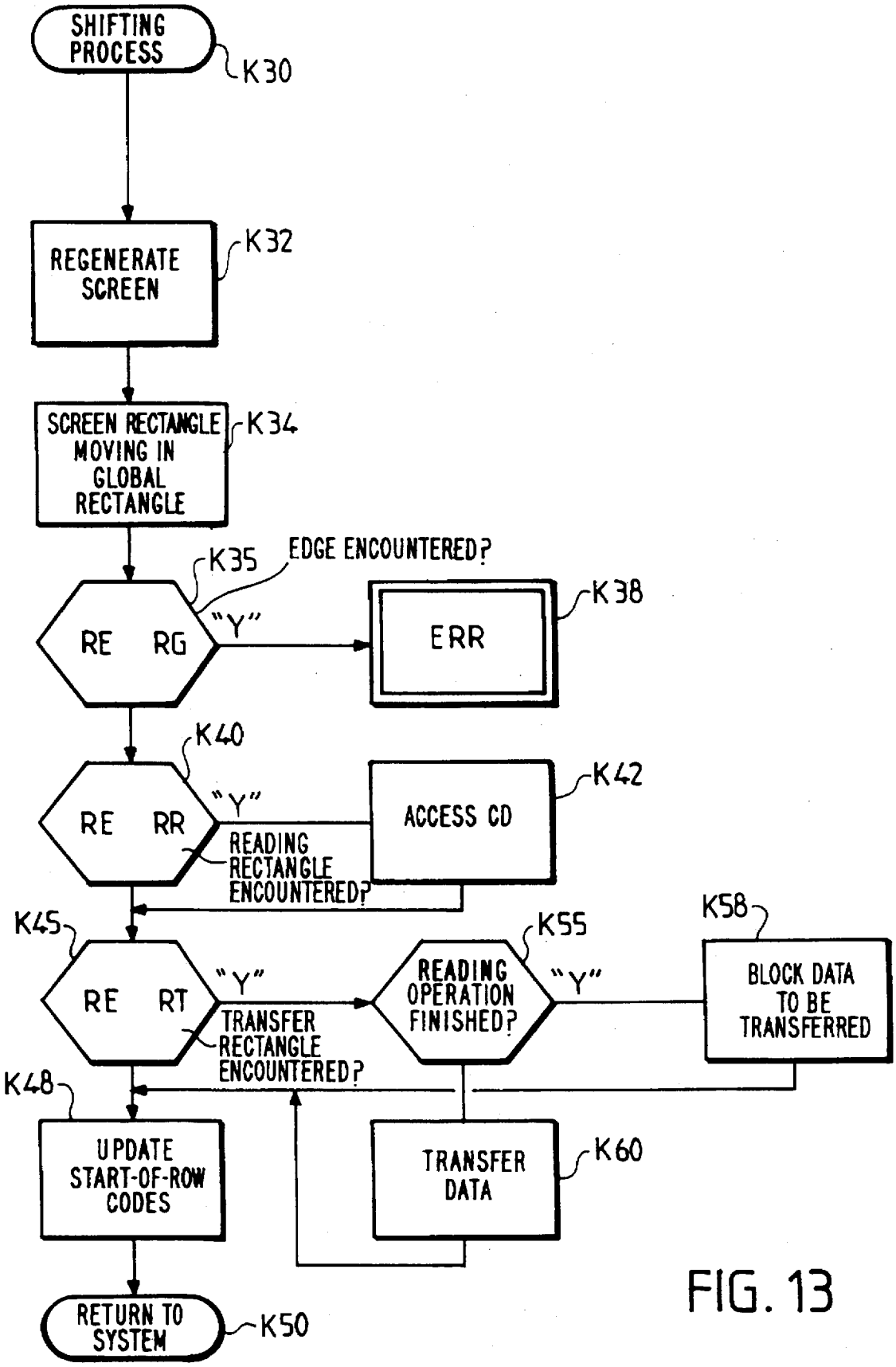

The process explained by the flow chart in FIG. 13 is triggered by a shifting process (box K30), then in box K32 the screen is regenerated, that is to say the updated start-of-row table is activated, which implies that the screen rectangle is moving in the global rectangle, box K34.

If the screen rectangle encounters an edge of the global rectangle (test of box K35), an error program is triggered, box K38.

If there is no error, a test is carried out to see whether the screen rectangle encounters the reading rectangle, box K40. If yes, the process goes to box K42 where an access to the compact disc is launched; if no, the process goes to box K45.

At box K45, an examination is carried out to see whether the screen rectangle encounters the transfer rectangle. If no, the process goes to box K48 where the memory of the start-of-row cedes is updated and where the contents of the transfer and reading rectangles are also updated and the process then goes to box K50 where there is a return to the system.

If the test at box K45 is positive, the process goes to box K55 where a test is carried out to see whether a reading operation already requested is finished or not. If the reading operation is not finished, the process goes to box K58 where any transfer of data from the supplementary memory into the memory containing the global rectangle is blocked, and the process then goes to box K48.

If the request to read is finished, the process goes from box K55 to box K60, where the transfer is carried out.

Figure 14:
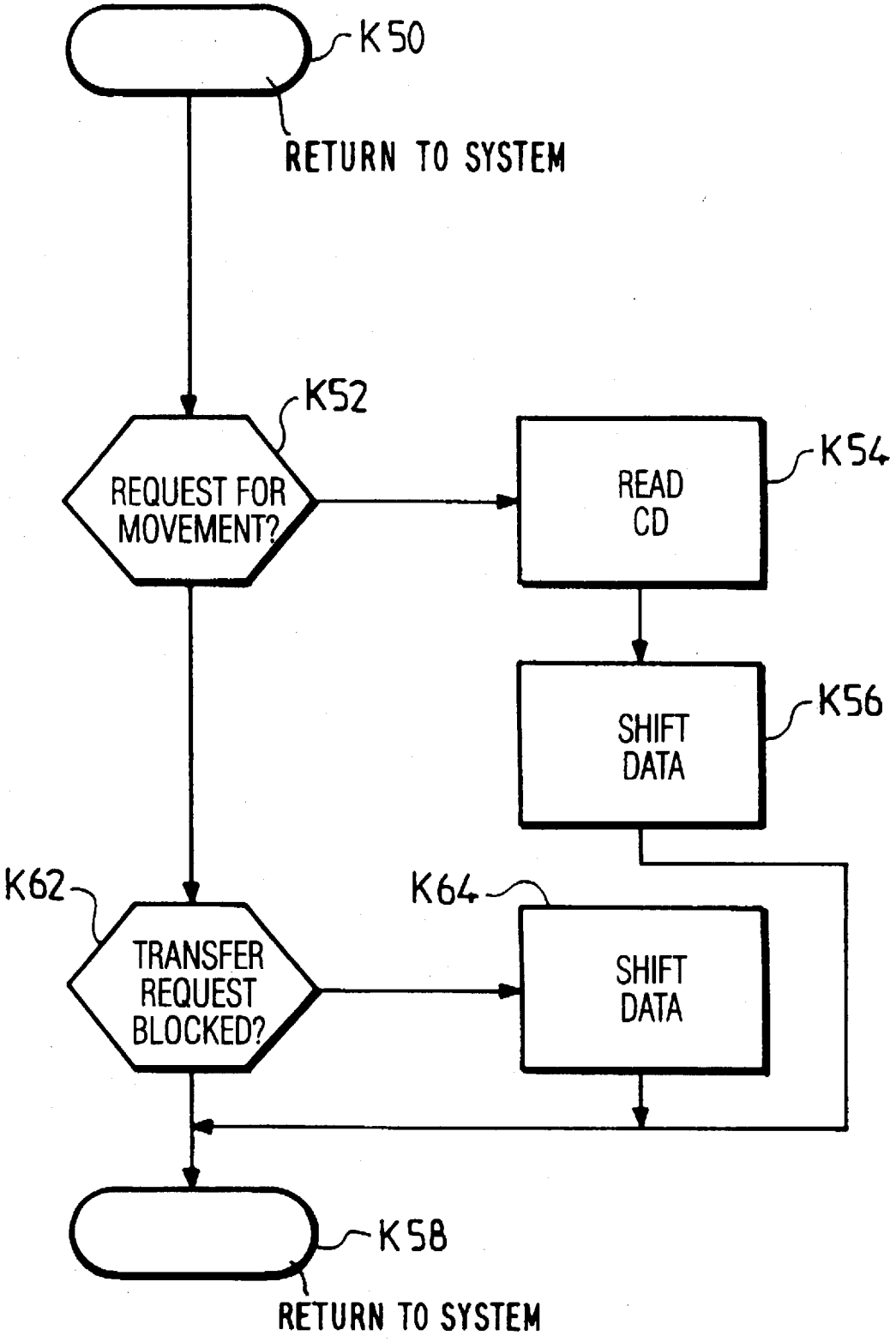

The process indicated by the flow chart of FIG. 14 is triggered by the end of the reading of the compact disc, box K500.

At box K52, a test is then carried out to see whether a request for movement has been made, for example at box K18. If yes, the process goes to box K54 where a reading of the CD is relaunched, followed by the shift process at box K56 before a return to the system at box K58. If no shift has been requested, the process goes from box K52 to box K62 where a test is carried out to see whether a transfer request has not been blocked (see for example box K58). If yes, the transfer is carried out at box K64 and then there is a return to the system at box K58. If no transfer has been requested, the process goes from box K62 to box K58.

In order to obtain a satisfactory movement, there is good reason to make a careful choice of the various parameters. This choice is based on the following considerations:

1. The number of pixels contained in a block should be as close as possible to a multiple k of the number of bytes $V_{CD}$ contained in a video sector of the CD (namely 2324 bytes). If w is the breadth in pixels of a block and h its height, the following relationship must hold:

$$w \cdot h \sim k \cdot V_{CD}$$

2. The time for reading a row of blocks of a screen rectangle should be roughly equal to the reading time of a column of blocks. If W is the number of blocks in a row, H the number of blocks in a column, $t_R$ the reading time of a block and $t_{seek}$ the time taken in positioning the reading head of the CD, the following relationship must hold:

$$W \cdot t_R + t_{seek} \sim H \cdot t_R + 2 \cdot t_{seek}$$

3. In order to have a buffer memory of minimum size, it is necessary for r to be a minimum:

$$\{(W \cdot w) \times (H \cdot h)\} / \{W_{SC} \times h_{SC}\} = r$$

where $w_{SC}$=breadth of the screen rectangle in pixels $h_{SC}$=height of the screen rectangle in pixels.

Figure 15:
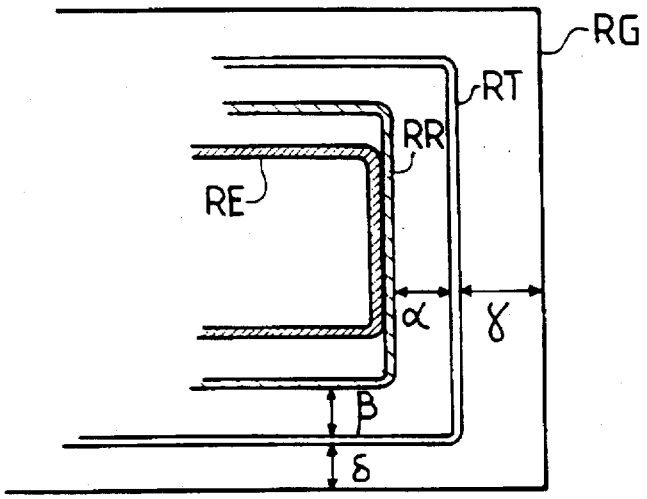
FIG. 15 shows the meaning of various parameters.

4. Knowing that the movement is made over the frame flyback time $T_{RT}$ of the screen scanning, it is necessary that:

$$\alpha \cdot T_{RT} > T_{RLCD}$$

that:

$$\beta \cdot T_{RT} > T_{RRCD}$$

that:

$$\gamma \cdot T_{RT} > T_{RM} + T_{OR}$$

and that:

$$\delta \cdot T_{RT} > T_{RM} + T_{OR}$$

where

α represents the number of pixels in a horizontal direction, separating RR from RT, β represents the number of pixels in a vertical direction, separating RR from RT, γ represents the number of pixels in a horizontal direction, separating RT from RG, δ represents the number of pixels in a vertical direction, separating RT from RG. (reference should be made to FIG. 15, where the magnitudes are illustrated more clearly), $T_{RLCD}$ is the reading time taken by the CD to read a row, $T_{RRCD}$ is the reading time taken by the CD to read a column, $T_{RM}$ is the time taken to transfer the blocks contained in the supplementary memory to the memory 5a, $T_{OR}$ is the time taken to update the various rectangles RR, RT and RG in the buffer memory.

5. If $H_S$ and $W_S$ are the numbers (not necessarily integers) of blocks corresponding to the rectangle RE, then the following should hold:

$$W-2<W_S<W-1$$

$$H-2<H_S<H-1$$

thus there is only one column or row to be loaded into the supplementary memory.

It is obvious that these considerations may lead to values other than those given above, without however going outside the scope of the invention.

We claim:

1. A method for displaying a portion of an image stored as a plurality of blocks of pixels in an image processing device, which image processing device comprises:

a bulk memory in which all said blocks of the image are stored, a user interface for selecting a first portion of the image to be displayed and including a scrolling means that upon being activated causes the user interface to select subsequent parts of the image to be displayed, a single buffer memory for storing blocks from the bulk memory and for containing at least a group of displayed pixels corresponding to the said moveable portion, a display unit for displaying this group of displayed pixels; said method comprising the steps of:

a) dividing said buffer memory into:

i. a global section having:

a first set of address boundaries defining a first group of m rows by n columns of blocks which is hierarchically organized into a transfer subsection having a second set of address boundaries, said transfer subsection comprising a reading section having a third set of address boundaries within said second set of address boundaries, said reading subsection comprising a screen subsection having a variable set of address boundaries defining the said group of displayed pixels defined at most m−1 rows by n−1 columns;

ii. a supplementary section having the capacity for storing at least the biggest number of blocks which one row or one column contains:

b) using said scrolling means to choose said variable set of address boundaries defining said displayed pixels among the global section;

c) storing a second group of blocks from said bulk memory to said supplementary section when at least one of said variable set of address boundaries intersects with at least one of said third set of address boundaries;

d) transferring the second group of blocks from said supplementary section to said global section when at least one of said variable set of address boundaries intersects with at least one of said second set of address boundaries;

e) updating all the sets of address boundaries after the transferring to take the transferred blocks in account.

2. A method for displaying a portion of an image stored as a plurality of blocks of pixels in an image processing device, which image processing device comprises:

a bulk memory in which all said blocks of the image are stored in respective arrays addressed by rows and columns, a user interface for selecting a first portion of the image to be displayed and including scrolling means that upon being activated causes the user interface to select subsequent parts of the image to be displayed in accordance with two directions one defined by the direction of the rows and the other by the direction of the columns, a single buffer memory for storing blocks from the bulk memory and for containing at least a group of displayed pixels corresponding to the said moveable portion, a display unit for displaying this group of displayed pixels; said method comprising the steps of:

a) dividing said buffer memory into:

i. a global section having:

a first set of address boundaries defining a first group of m rows by n columns of blocks which is hierarchically organized into a transfer subsection having a second set of address boundaries, said transfer subsection comprising a reading section having a third set of address boundaries within said second set of address boundaries, said reading subsection comprising a screen subsection having a variable set of address boundaries defining the said group of displayed pixels defined at most m−1 rows by n−1 columns;

ii. a supplementary section having the capacity for storing at least the biggest number of blocks which one row or one column contains:

b) using said scrolling means to choose said variable set of address boundaries defining said displayed pixels;

c) storing a second group of blocks from said bulk memory to said supplementary section when at least one of said variable set of address boundaries intersects with at least one of said third set of address boundaries, this second group comprising m blocks of a row when the moving of the moveable portion is directed to a row or n blocks of a column when the moveable portion is directed to a column;

d) transferring the second group of blocks from said supplementary section to an area of said global section when at least one of said variable set of address boundaries intersects with at least one of said second set of address boundaries, this area being at the outside of the screen section opposite to the direction of movement of the moveable portion;

e) updating all the sets of address boundaries after the transferring to take the transferred blocks in account by the amount of the pixels corresponding to the dimensions of the blocks.

* * * * *